US005871142A

United States Patent [19]

Josephson

[11] Patent Number: 5,871,142

[45] Date of Patent: Feb. 16, 1999

[54] CONTAINER MADE FROM FOLDABLE PANELS

[75] Inventor: Steve Josephson, Huntington Park, Calif.

[73] Assignee: Traffic Works, Inc., Huntington Park, Calif.

[21] Appl. No.: 928,655

[22] Filed: Sep. 12, 1997

[51] Int. Cl.[6] ..... B65D 25/04

[52] U.S. Cl. ..... 229/120.09; 229/125.11; 229/67.4

[58] Field of Search ..... 229/125.08, 125.11, 229/67.1, 120.09, 67.4, 153, 122.21, 125.09; 140/901

[56] References Cited

U.S. PATENT DOCUMENTS

| | | | |
|---|---|---|---|
| 603,872 | 5/1898 | Bucklin | 229/120.09 X |
| 1,406,683 | 2/1922 | Regan | 220/334 |
| 1,474,948 | 11/1923 | Stephenson | 229/67.4 |
| 1,754,663 | 4/1930 | Adams | 190/901 X |
| 1,824,491 | 9/1931 | Molins | 229/120.09 X |
| 1,906,742 | 5/1933 | Coulapides | 229/120.09 X |
| 2,320,018 | 5/1943 | Ullman | 229/120.09 X |
| 2,447,279 | 8/1948 | Rosenfeld | 229/120.09 X |
| 2,735,610 | 2/1956 | Young | 229/125.11 |
| 4,014,458 | 3/1977 | Berges | 220/334 X |
| 4,099,647 | 7/1978 | Bergh et al. | 229/125.11 X |
| 4,205,776 | 6/1980 | Ruer | 229/38 |
| 4,294,353 | 10/1981 | Focke et al. | 229/120.09 X |
| 5,174,443 | 12/1992 | Chance et al. | 229/120.11 X |
| 5,381,920 | 1/1995 | Lin | 220/342 |
| 5,664,724 | 9/1997 | Ho | 229/67.4 |

*Primary Examiner*—Jes F. Pascua
*Assistant Examiner*—Tri M. Mai
*Attorney, Agent, or Firm*—Longacre & White

[57] ABSTRACT

A container assembly having at least two uniquely-shaped, foldable blanks that can be stored, packaged and transported in substantially flat condition. Each of the flat foldable blanks are easily folded to form a pocket capable of containing papers or other small office supplies. The two pockets are hingedly attached to one another to form a container resembling a briefcase. Preferably, the hinges are formed of a substantially flat resilient material having locking tabs which may be folded and inserted into slots of each of the two pockets and retained by each pocket. The two pockets then being hingedly attached to one another. One pocket may be formed with a cover flap having a clasp to cover both of the pockets and facilitate securement of the two pockets in a closed position.

7 Claims, 5 Drawing Sheets

FIG. 6A
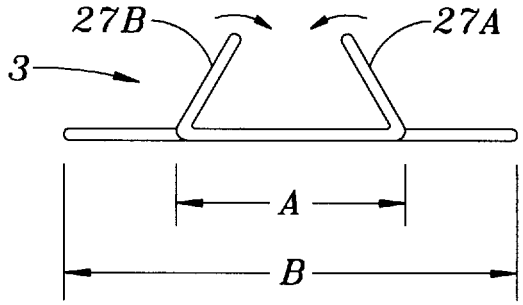
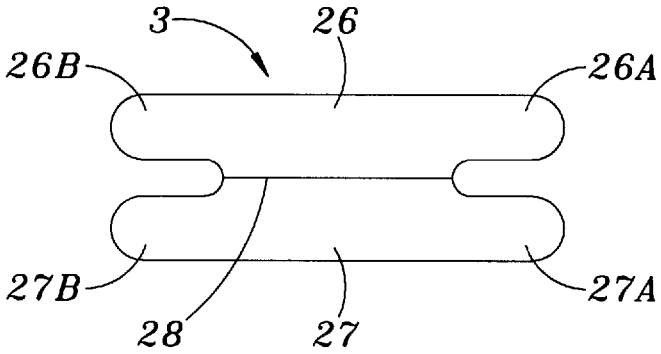
FIG. 6B
FIG. 7
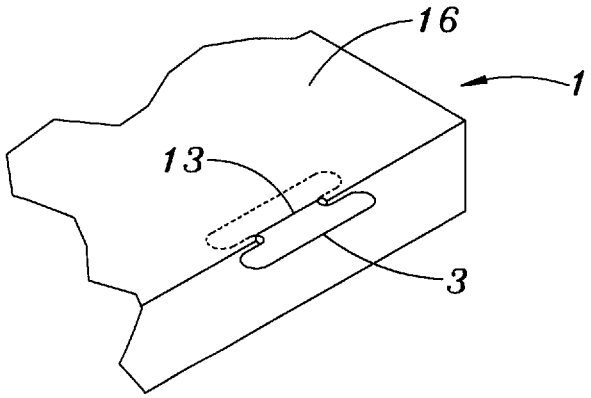

CONTAINER MADE FROM FOLDABLE PANELS

BACKGROUND OF THE INVENTION

1. Field of the Invention

The present invention relates generally to a container assembly for holding a variety of materials, such as papers, that is easy to manufacture, transport and assembly. The container of the present invention is particular directed to a briefcase or a two pocket folder having two portions each formed from a single foldable panel and uniquely hinged together.

2. Description of Prior Art

In an office, schoolroom, den, or any other environment, many different types of containers are abundantly used for collecting and storing papers and small office supplies such as pens, pencils, sharpeners, paper clips etc. Typically, known prior art container devices are either totally rigid or are of the form of simple folders made of flexible materials. A totally rigid construction makes the known devices expensive to manufacture as well as bulky, awkward and difficult to transport from one location to another. Other containers, such as plastic folders are well known in the art. However, these folders do not have separate containers hinged together to resemble a briefcase.

There therefore exists a need for an inexpensive container assembly which can be easily and conveniently employed in a wide variety of environments, both indoors and outdoors, which container assembly can be stored and shipped in a compact, flat package and can be easily and readily assembled and disassembled by a single non-skilled person without tools and without external fasteners or other components.

SUMMARY OF THE INVENTION

The present invention teaches the construction and operation of a container assembly wherein the container consists of at least two uniquely-shaped, foldable blanks that can be stored, packaged and transported in substantially flat condition. A structure resembling a briefcase is formed from these two flat foldable blanks, or body panels, that are preferably made of a resilient, but semi-stiff material. When folded into a container, this structure resembles a briefcase or folder having two separate pockets each hingedly attached to one another.

In its preferred embodiment, the present container assembly is comprised primarily of two single flat sheets of a resilient type material which are shaped and hinged together to form a two pocket folder or briefcase. The blanks may be imprinted, embossed or otherwise decorated with indicia such as a company logo, promotional material, or other data. In one embodiment, it is envisioned that the two pockets can be unassembled and further returned to its original flat condition. The foldable blanks forming the present container can be packaged, stored and furnished in substantially flat form and they can be easily assembled and disassembled without tools or other means.

In its folded state, each pocket has tabs which when folded adhere, or otherwise attach, to one another to form the pocket. Each pocket is formed with a slot to receive a hinge. The hinge is made of a resilient material which may be inserted into the slots of each pocket to hingedly attach the two pockets together.

With this invention, the foldable body panel can be imprinted, embossed, engraved, etched or otherwise decorated with indicia and can be easily and simultaneously used as a sign to promote the sale of goods and/or services in a commercial setting to promote an activity or event, or to convey any particular message in an office or other environment. Because the foldable blanks of this invention are easily manufactured and shipped, this enables a user to imprint a company logo, advertising promotional material, or any other message on the body panel and to display the same when the present device is utilized as a promotional container. Since the body panel is made of a lightweight, preferably resilient or flexible, material as will be hereinafter explained, it can be easily manufactured, transported and assembled for use as a container assembly. The present assembly affords a user a simple arrangement to assemble, particularly, in a commercial environment where one is promoting and merchandising goods and/or services for short period of time with the constant need to replace one advertisement with another in a simple and inexpensive manner.

These and other objects and advantages of the present invention will become apparent to those skilled in the art after considering the following detailed specification in conjunction with the accompanying drawings.

BRIEF DESCRIPTION OF THE DRAWINGS

FIGS. 6 A and B represent side and top plan views of a hinge to attach the two pockets to one another.

FIG. 7 represents a perspective view of the hinged secured to one of the pockets.

DETAILED DESCRIPTION OF THE INVENTION

Figure 1:
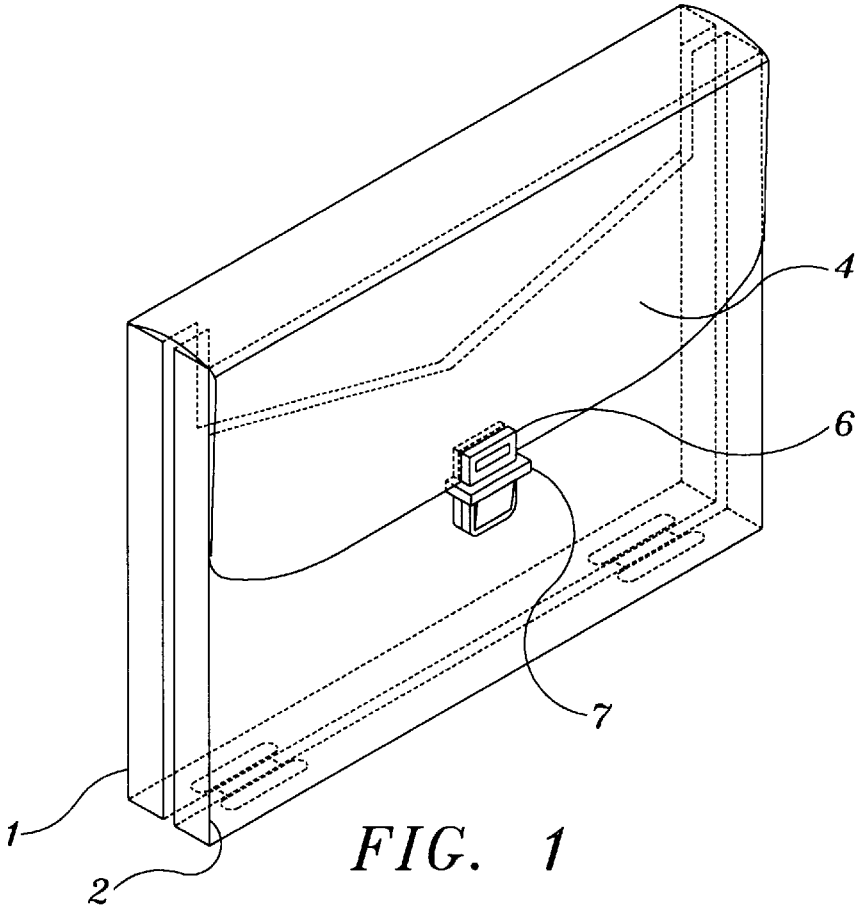
FIG. 1 is a perspective view of the container shown in a closed state.
Figure 2:
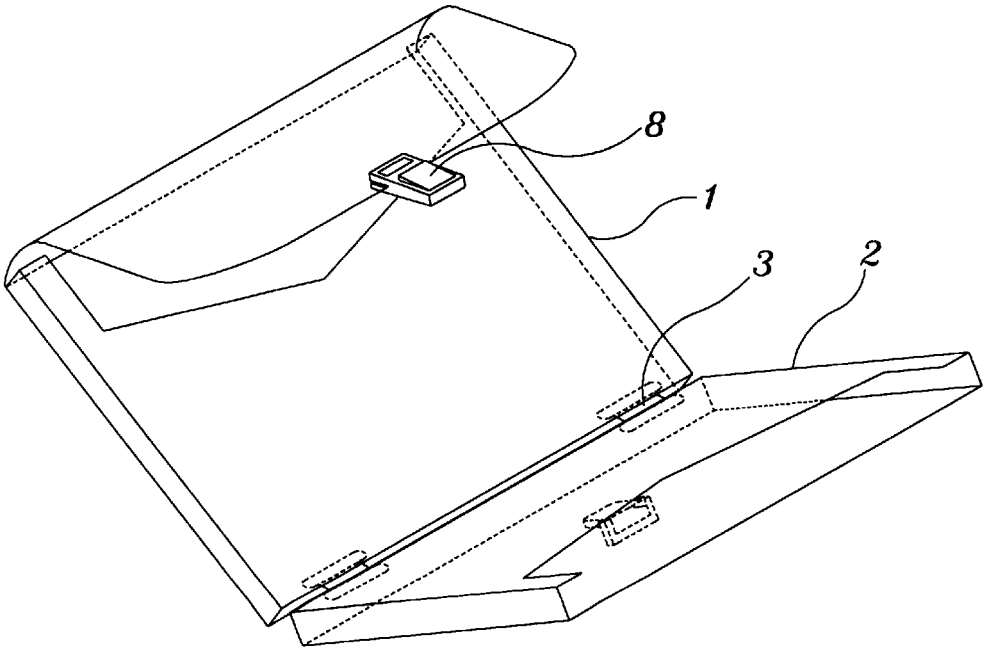
FIG. 2 is a perspective view of the container in a partially open state.
Figure 3:
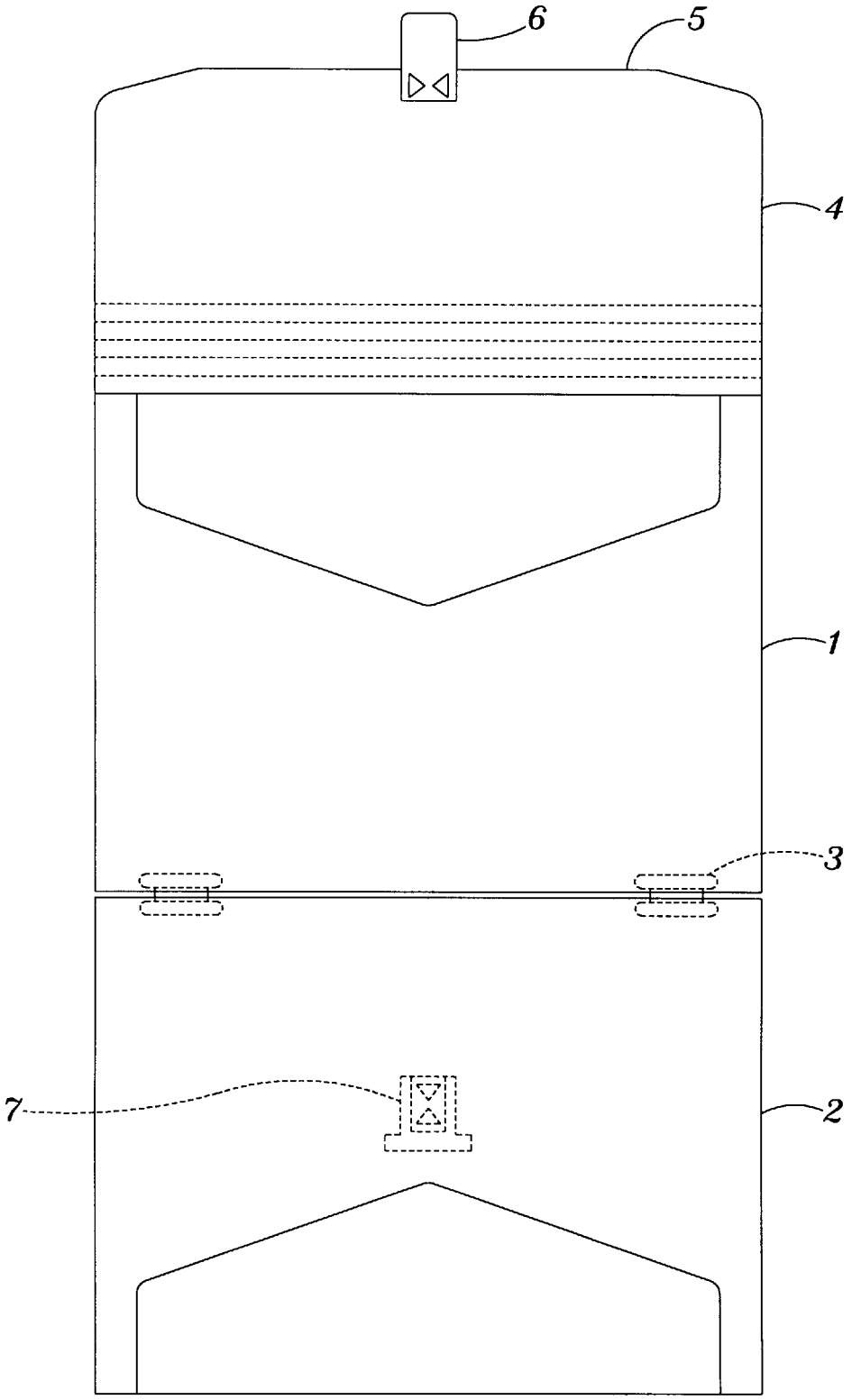
FIG. 3 is a plan view of the container in an open state.

Referring to FIG. 2, the container of the preferred embodiment hast a first pocket 1, and a second pocket 2, hingedly attached to one another by hinges 3. FIG. 3 represent the container in an open state. In this condition the first pocket 1, and second pocket 2, lie substantially flat in the same plane. FIG. 1, represents the container of the preferred embodiment in a closed state.

To maintain the container in a closed state, pocket 1, has a cover flap 4. The cover flap 4 extends from the first pocket 1 terminating at and edge. Attached to the edge of the cover flap 4 is a buckle 6. The second pocket 2, has a clasp 7 adapted to receive and retain the buckle 6. To close the container of the preferred embodiment, the first pocket 1, and second pocket 2 are simply rotated toward one another about hinge 3, the cover flap 4 is folder over the first pocket 1 and second pocket 2, and the buckle 6 inserted into the clasp 7.

It is noted that the particular means to secure the cover flap to the second pocket 2 may embody any one of numerous well know securement devices. For example, the buckle and clasp arrangement may take the form of a snap fit clip, a magnetic clip, a securement strap and button combination, or any of the commonly know ways to secure two articles to one another. In the preferred embodiment, the buckle 6 and clasp 7 arrangement takes the form of a snap fit form. Buckle 6 has an outwardly biased wedge portion 8. The wedge portion is simply inserted into the clasp 7 far enough that the wedge portion springs back to an outwardly position and caught by the claps 7 to prevent the buckle from dislodging therefrom. When it is desired to dislodge the wedge portion 8, it is simply depressed inwardly to allow the wedge portion to pass through the buckle facilitating disengagement. The cover flap may then be folded back and the first and second pockets open apart from one another.

Figure 4:
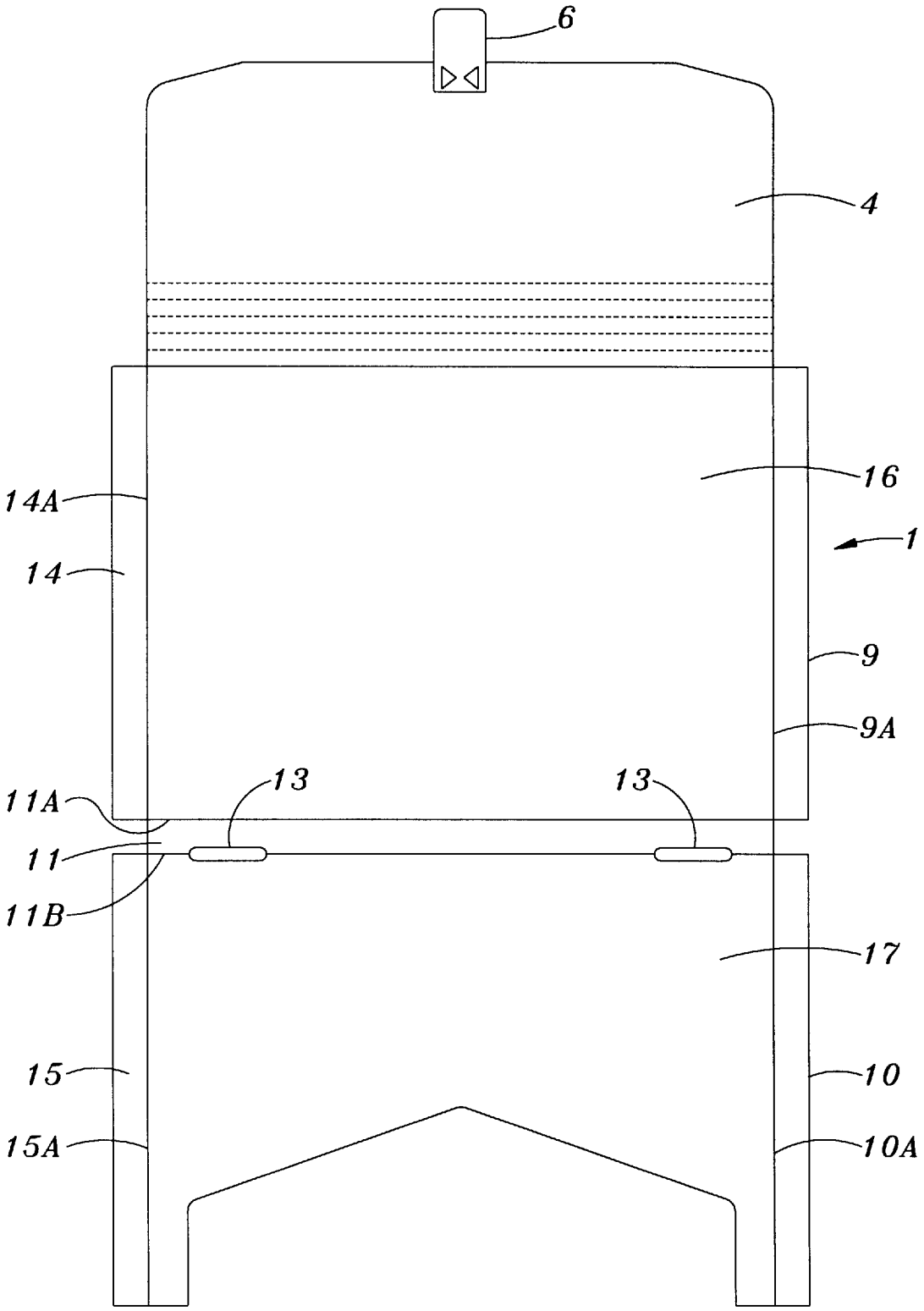
FIG. 4 is a plan view of the first pocket in an unfolded unassembled state.

FIG. 4 represents a top plan view of the first pocket 1 in its unfolded state. First pocket 1 has an outside panel 16 having tabs 9, and 14 and an inside panel 17 having tabs 10 and 15. Tabs 9, 10, 14, and 15 are respectively folded about fold lines 9*a*, 10*a*, 14*a*, 15*a*. Middle panel 11 defines the thickness of the pocket when in the folded stated. To form the first pocket, the outside panel is folded about fold line 11*a*, inside panel is folded about fold line 11*b* and tabs 9, 10, 14, and 15 are respectively folded about fold lines 9*a*, 10*a*, 14*a*, 15*a*. To retain the first pocket in the folded state, tabs 9 and 10, and 14 and 15 are respectively secured to one another. In the preferred embodiment, these tabs are adhered to one another by the use of an adhesive applied to the appropriate side of one of each of tabs (9 and 10), and (14 and 15). However, it is understood that other means to secure these tabs may also be employed, such as by welding, hot melting, reversible mechanical securement devices, or other permanent or reversible mechanical interconnecting structures such as engaging locking tabs. In one embodiment, adhesive is pre-applied to the appropriate side of one of tabs 9, 10 and 14, 15 and covered by a protective strip. Another embodiment may employ double sided tape applied to the appropriate side of at least one of each of one of the tabs 9, 10 and 14, 15. The pocket 1, may be shipped in the un-folded stated with the adhesive and protective strip. To assemble the pocket, the protective strip is simply removed from each of one the tabs (9, 10) and (14, 15), to expose the adhesive and the first pocket folded about each of the fold lines and the tabs (9 and 10), and (14 and 15) are properly aligned and pressure applied to adhere to tabs together thus forming the first pocket in the folded state.

In the preferred embodiment, pocket 1, has two slits 13 formed in the fold line 11*a* between the outside side 16 and the middle panel 11. These slits are formed to accommodate hinges to facilitate hinged attachment to the second panel 2.

Figure 5:
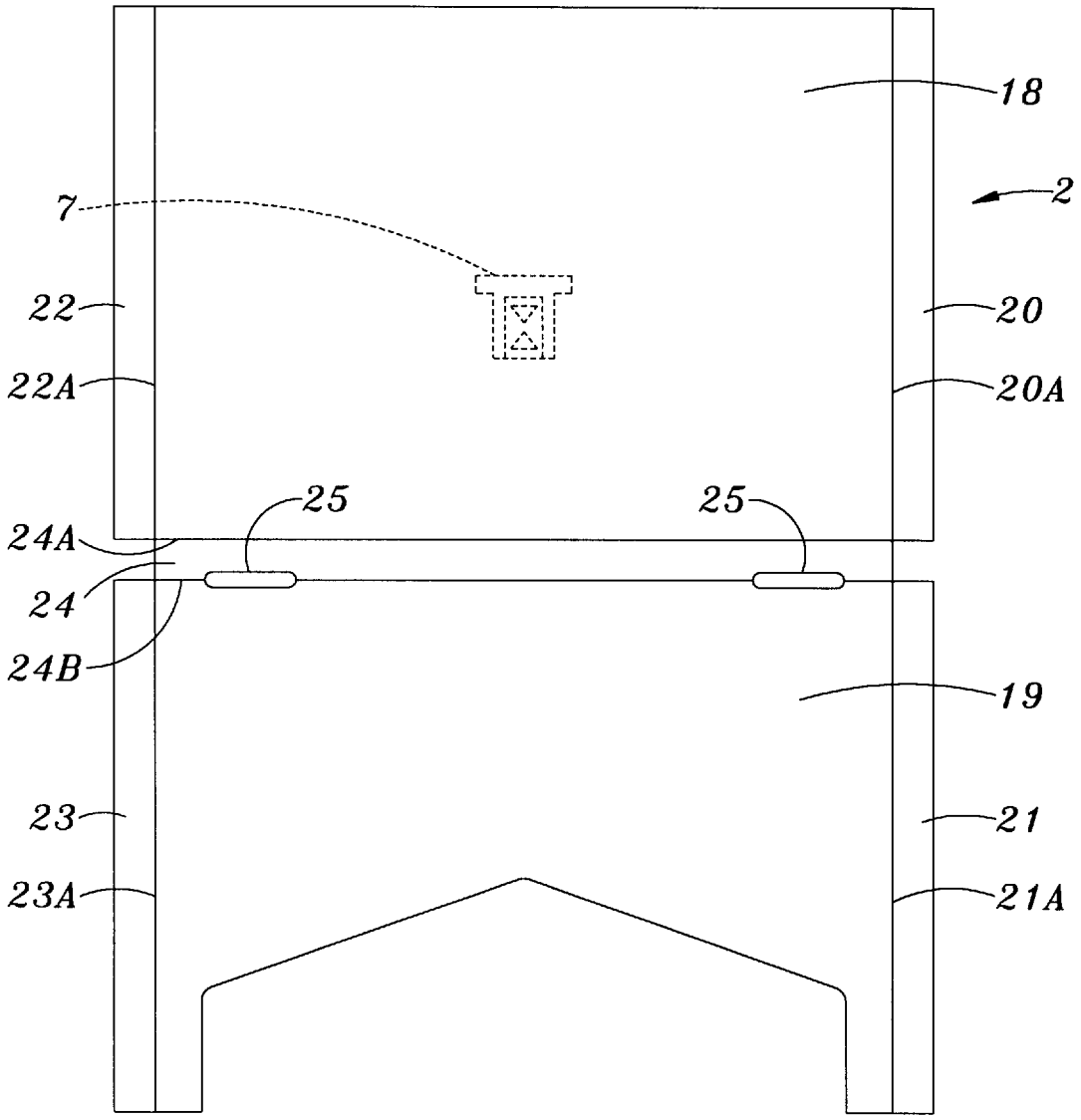
FIG. 5 is a plan view of the second pocket in an unfolded unassembled state.

FIG. 5 represents second pocket 2 in an unfolded state. Similar to first panel 1, the second pocket 2 has an outside panel, 18 (to which clasp 7 is secured), an inside panel 19, tabs 20, 21, 22, 23, respective fold lines 20*a*, 21*a*, 22*a*, 23, middle panel 24 and associated fold lines 24*a*, 24*b* and slots 25. The second pocket 2 is constructed similarly as that of first pocket 1 and will not be specifically discussed herein.

FIGS. 6*a* and 6*b* represents side and top plan views, respectively, of the hinge 3 used to hingedly attach the first pocket 1 and second pocket 2 to one another. The hinge 3 has two sides foldable about fold line 28. Each side 26, 27, has end tab portions 26*a*, 26*b*, 27*a*, 27*b* respectively foldable about fold lines to facilitate insertion of the side into one of the slots of the first and second pockets 1, 2.

FIG. 6*a* depicts a tab portions 27*a*, and 27*b* folded back onto a central portion of the side portion 27. To secure the hinge to one of the pockets 1, or 2, the tabs are fold substantially back onto and parallel to the side portion and inserted into one of the slots 13, or 25 to attached the hinge to the pocket. Once the side portion is fully inserted into the slot and disposed within the pocket, the tabs will unfold, or may be manually unfolded outward substantially returning to its initial position. The length of the slots is designed to be smaller than the overall length of the hinge as represented by the distance b of FIG. 6*a*, and larger that central portion of the hinge as represented by the line a of FIG. 6*a*. In this way, once the hinge is inserted into the slot, it will be retained thereto. Alternately, only one of the tabs is folded back onto the central portion of the hinge. The tab remaining flat may be first inserted into the slot, while the opposite tab is folded and then inserted into the slot to retain the hinge to the pocket. Such procedure will increase the ease of assembly while promoting the expanded shape of the installed hinge.

FIG. 7 depicts a hinge 3 attached to the first pocket 1 by way of the aforementioned procedure. Once a hinge 3 is inserted into each slot of the first panel 1, the tab portions of the exposed side of the hinge are folded back onto itself as previously discussed, and the hinge is inserted into the slots 25 of the second panel 2. The first and second pockets 1, 2 are thus hingedly attached to one another and may be folded about fold lines 28 of the hinges between a closed and open position as respectively shown by FIGS. 1 and 3.

It should be understood that the flat panels of this invention greatly facilitates transportation and easy assembly capability enhancing portability from one location to another. It should also be recognized that various acceptable materials of construction are available and could equally be employed to fabricate the various components of the present invention. For example, the panels could be made from any resilient type material as previously explained such as certain resilient, plastic materials, certain rubber-like materials, paper-board, certain metals and metal alloys as well as certain types of treated fabric materials so long as such materials are resilient or flexible enough to allow for sufficient bending of the panel members to achieve a resilient multi-sided form and such materials are of sufficient rigidity to stand on end to form the container assembly. It is also recognized that a wide variety of cooperatively engageable joining means other than the adhesion of tabs (9, 10), and (14, 15), etc. as illustrated in the accompanying drawings, may be utilized to suitably fasten and attach these panels into their folded state.

It is also important to note that the overall dimensions of the present container assemblies as well as the particular location and configuration of the various construction features associated therewith such as buckle 6 and clasp 7, and the slots 13, 25 etc. are subject to wide variations, each may be sized and shaped into a wide variety of different sizes and configurations; and each may be incorporated into any of the present panel members in any combination thereof without impairing the teachings and practices of the present invention. The durability, flexibility and versatility of the present multipurpose container greatly increases its usefulness and effectiveness in a wide variety of applications.

The present invention therefore provides a multi-purpose container structure which can easily receive printing to promote goods and/or services, convey a message or present a unique design. The construction and operation of a container assembly can be packaged, stored and shipped in a substantially flat condition, and can be easily assembled without the use of tools or other fastener means for assembling the same.

The container assembly is constructed of a relatively lightweight resilient material which is sturdy and able to withstand normal usage. This container assembly is relatively simple and easy to manufacture, ship and assemble.

While the foregoing invention has been shown and described with reference to a preferred embodiment, it will be understood by those possessing skill in the art that various changes and modifications may be made without departing from the spirit and scope of the invention. For example, the specific shape and material of the hinge 3 may of various configurations. While the hinge 3, is preferably made of a resilient flexible plastic material, metals, alloys, synthetic and natural treated fabrics, and paper/cardboard material, all may be employed for an appropriate environment. Additionally, the preferred embodiments depicts the first and second pockets formed as substantially mirror images of one another. Embodiments incorporating different shapes and configurations between the first and second pockets are also intended to fall within the scope of the instant invention. Furthermore, a handle may be placed on the external surface of cover flap 4 to facilitate carrying of the container as in a conventional briefcase.

What is claimed is:

1. A container formed of a thin resilient material to contain paper and small office supplies, said container comprising:

a first pocket formed from a first single foldable blank defining a first substantially rectangular shaped box;

a second pocket formed from a second single foldable blank defining a second substantially rectangular shaped box;

at least one hinge hingedly secured to each of said first and second pockets to hingedly secure said first and second pockets to one another; wherein said first pocket further comprises at least one first slot;

said second pocket comprises at least one second slot; and said at least one hinge comprises at least one substantially flat hinge, said at least one substantially flat hinge having a first and second side, each of said first and second sides having a pair of oppositely extending locking tabs, wherein said at least one substantially flat hinge is at least partially disposed through said at least one first slot and said at least one second slot, said pair of locking tabs of said first side being disposed within said first pocket to secure said hinge to said first pocket and said pair of locking tabs of said second side being disposed in said second pocket to secure said hinge to said second pocket thereby hingedly securing said first pocket to said second pocket.

2. The container according to claim 1, wherein said first and second sides are foldable along a center fold line such that said first and second pockets are hingedly foldable about said fold line.

3. A container formed of a thin resilient material to contain paper and small office supplies, said container comprising:

a first pocket formed from a first single foldable blank defining a first substantially rectangular shaped box;

a second pocket formed from a second single foldable blank defining a second substantially rectangular shaped box;

at least one hinge hingedly secured to each of said first and second pockets to hingedly secure said first and second pockets to one another;

wherein said first pocket further comprises:

a substantially rectangular outside panel, said outside panel having a pair of opposite laterally extending folding tabs, a substantially rectangular inside panel, said inside panel having a pair of opposite laterally extending folding tabs, a middle panel disposed between said inside and outside panels;

wherein said first pocket is formed by folding said outside and inside panels about fold lines respectively defined by a boundary between said middle panel and said outside and inside panels, said pair of tabs of said outside panel each being adhered to a corresponding one of said pair of tabs of said inside panel to retain said first pocket in a shape of said first substantially rectangular shaped box;

wherein said second pocket comprises:

a second substantially rectangular outside panel, said outside panel having a second pair of opposite laterally extending folding tabs, a second substantially rectangular inside panel, said inside panel having a pair of opposite laterally extending folding tabs, a second middle panel disposed between said inside and outside panels, wherein said second pocket is formed by folding said second outside and inside panels about fold lines respectively defined by a boundary between said second middle panel and said second outside and inside panels of said second pocket, said second pair of tabs of said second outside panel each being adhered to a corresponding one of said second pair of tabs of said inside panel to retain said second pocket in a shape of said second substantially rectangular shaped box, wherein;

said first pocket further comprises at least one first slot;

said second pocket further comprises at least one second slot; and said at least one hinge comprises at least one substantially flat hinge, said at least one substantially flat hinge having a first and second side, each of said first and second sides having a pair of oppositely extending locking tabs, wherein said at least one substantially flat hinge is at least partially disposed through said at least one first slot and said at least one second slot, said pair of locking tabs of said first side being disposed within said first pocket to secure said hinge to said first pocket and said pair of locking tabs of said second side being disposed in said second pocket to secure said hinge to said second pocket thereby hingedly securing said first pocket to said second pocket.

4. A combination container and hinge, said combination comprising:

a first pocket adapted to contain paper and small office supplies, said first pocket having at lease one first slot;

a second pocket adapted to contain paper and small office supplies, said second pocket having at lease one second slot;

at least one substantially flat hinge, said hinge having a first and second side, each of said first and second sides having a pair of oppositely extending locking tabs, wherein said at least one substantially flat hinge is at least partially disposed through said at least one first slot and said at least one second slot, said pair of locking tabs of said first side being disposed within said first pocket to secure said hinge to said first pocket and said pair of locking tabs of said second side being disposed in said second pocket to secure said hinge to said second pocket thereby hingedly securing said first pocket to said second pocket about.

5. The combination container and hinge according to claim 4, wherein said first and second sides of said hinge are foldable along a center fold line such that said first and second pockets are hingedly foldable about said center fold line.

6. The combination container and hinge according to claim 4, wherein, said first pocket is formed from a first single foldable blank defining a first substantially rectangular shaped box; and a said second pocket is formed from a second single foldable blank defining a second substantially rectangular shaped box.

7. The combination container and hinge according to claim 6, wherein;

said first pocket further comprises:

a substantially rectangular outside panel, said outside panel having a pair of opposite laterally extending folding tabs, a substantially rectangular inside panel, said inside panel having a pair of opposite laterally extending folding tabs, a middle panel disposed between said inside and outside panels, wherein said first pocket is formed by folding said outside and inside panels about fold lines respectively defined by the boundary between said middle panel and said outside and inside panels, said pair of tabs of said outside panel each being adhered to a corresponding one of said pair of tabs of said inside panel to retain said first substantially rectangular shaped box; and said second pocket comprises:

a second substantially rectangular outside panel, said second outside panel having a pair of opposite laterally extending folding tabs, a second substantially rectangular inside panel, said second inside panel having a pair of opposite laterally extending folding tabs, a second middle panel disposed between said inside and outside panels, wherein said second pocket is formed by folding said second outside and inside panels along fold lines respectively defined by boundaries between said second middle panel of said second pocket and said second outside and inside panels, said pair of tabs of said second outside panel each being adhered to a corresponding one of said pair of tabs of said second inside panel to retain said second pocket in a shape of said substantially rectangular shaped box.

* * * * *